US008979555B2

(12) United States Patent
Lin et al.

(10) Patent No.: US 8,979,555 B2
(45) Date of Patent: Mar. 17, 2015

(54) SIGNAL TRANSMITTING CONNECTOR

(71) Applicant: Gemtek Technology Co., Ltd., Hukou Township, Hsinchu County (TW)

(72) Inventors: Zi-Xiang Lin, Hukou Township, Hsinchu County (TW); Shih-Ching Lee, Hukou Township, Hsinchu County (TW)

(73) Assignee: Gemtek Technology Co., Ltd., Hukou Township, Hsinchu County (TW)

( * ) Notice: Subject to any disclaimer, the term of this patent is extended or adjusted under 35 U.S.C. 154(b) by 68 days.

(21) Appl. No.: 14/026,464

(22) Filed: Sep. 13, 2013

(65) Prior Publication Data

US 2015/0004811 A1 Jan. 1, 2015

(30) Foreign Application Priority Data

Jun. 26, 2013 (TW) ..... 102122837 A

(51) Int. Cl.
*H01R 12/00* (2006.01)
*H01R 13/66* (2006.01)
*H01R 13/512* (2006.01)

(52) U.S. Cl.
CPC ..... *H01R 13/665* (2013.01); *H01R 13/512* (2013.01)
USPC ..... 439/76.1

(58) Field of Classification Search
USPC ..... 439/76.1, 66, 493, 946, 490, 620.22
See application file for complete search history.

(56) References Cited

U.S. PATENT DOCUMENTS

| | | | | |
|---|---|---|---|---|
| 8,864,515 | B2 * | 10/2014 | Oh | 439/490 |
| 8,926,339 | B2 * | 1/2015 | Houtz | 439/76.1 |
| 2008/0045049 | A1 * | 2/2008 | Collantes et al. | 439/76.1 |
| 2009/0098746 | A1 * | 4/2009 | Chiu et al. | 439/76.1 |

* cited by examiner

*Primary Examiner* — Jean F Duverne
(74) *Attorney, Agent, or Firm* — Muncy, Geissler, Olds & Lowe, P.C.

(57) ABSTRACT

A signal transmitting connector includes a metal base and a circuit board. The metal base includes a bottom plate, a first and a second lateral plate. The bottom plate includes a first surface, an opposite second surface, and an edge surface between the first and second surface. The first and the second lateral plate are connected to the first surface. An extending plane of the edge surface is intersected by the first and the second lateral plate. The bottom plate, the first and the second lateral plate form a depression. The circuit board, disposed in the depression, includes a third surface where a first electrically connecting portion is disposed, and an opposite fourth surface. A first distance, between a first lateral side edge of the edge surface away from the second surface and the second surface, is less than a second distance between the third and the second surface.

18 Claims, 12 Drawing Sheets

SIGNAL TRANSMITTING CONNECTOR

CROSS-REFERENCE TO RELATED APPLICATIONS

This non-provisional application claims priority under 35 U.S.C. §119(a) on Patent Application No(s). 102122837 filed in Taiwan, R.O.C. on Jun. 26, 2013, the entire contents of which are hereby incorporated by reference.

TECHNICAL FIELD

The disclosure relates to a signal transmitting connector, in particularly to a signal transmitting connector including a metal housing.

BACKGROUND

With the improvement of technology, soft disks and compact disks, which are used for the storage and carrying of electronic information, have been replaced by flash drives integrated with a Universal Serial Bus (USB) interface. Because the flash drives have a smaller size, being capable of hot swapping, having a fast transmitting speed and a large storage volume, it is favorable for consumers to adopt them for storing data.

Because the related technologies of the flash drives have been matured, products made by each manufacturer are similar to each other. Therefore, the consumers consider not only the performance of the flash drives but also the appearance, quality and operational convenience of the flash drives.

Generally speaking, the quality of metal material is superior to that of plastic material, so consumers tend to prefer the flash drive including a metal housing. When the USB plug of the flash drive including the metal housing is plugged into the USB port, a metal flexible sheet of the USB port may be in contact with the metal housing so as to make the electronic device including the USB port short circuit, which bombards the consumers. Therefore, how to maintain the quality of the flash drive without affecting the electrical connection between the flash drive and the USB port is a problem that manufacturers try to solve.

SUMMARY

An embodiment of the disclosure provides a signal transmitting connector comprising a metal base and a circuit board. The metal base includes a bottom plate, a first lateral plate and a second lateral plate. The bottom plate includes a first surface, a second surface and an edge surface. The second surface and the first surface are opposite to each other. The edge surface is connected between the first surface and the second surface. The first lateral plate and the second lateral plate are connected to two opposite sides of the first surface, respectively. An extending plane of the edge surface is intersected by the first lateral plate and the second lateral plate. The bottom plate, the first lateral plate and the second lateral plate form a depression together. The circuit board, disposed in the depression, includes a third surface and a fourth surface opposite to each other. The fourth surface faces the bottom plate. A first electrically connecting portion is disposed on the third surface. At least a part of a first lateral side edge of the edge surface away from the second surface and the second surface are separated by a first distance. The third surface and the second surface are separated by a second distance. The first distance is less than the second distance.

BRIEF DESCRIPTION OF THE DRAWINGS

The disclosure will become more fully understood from the detailed description given herein below for illustration only, thus does not limit the disclosure, wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
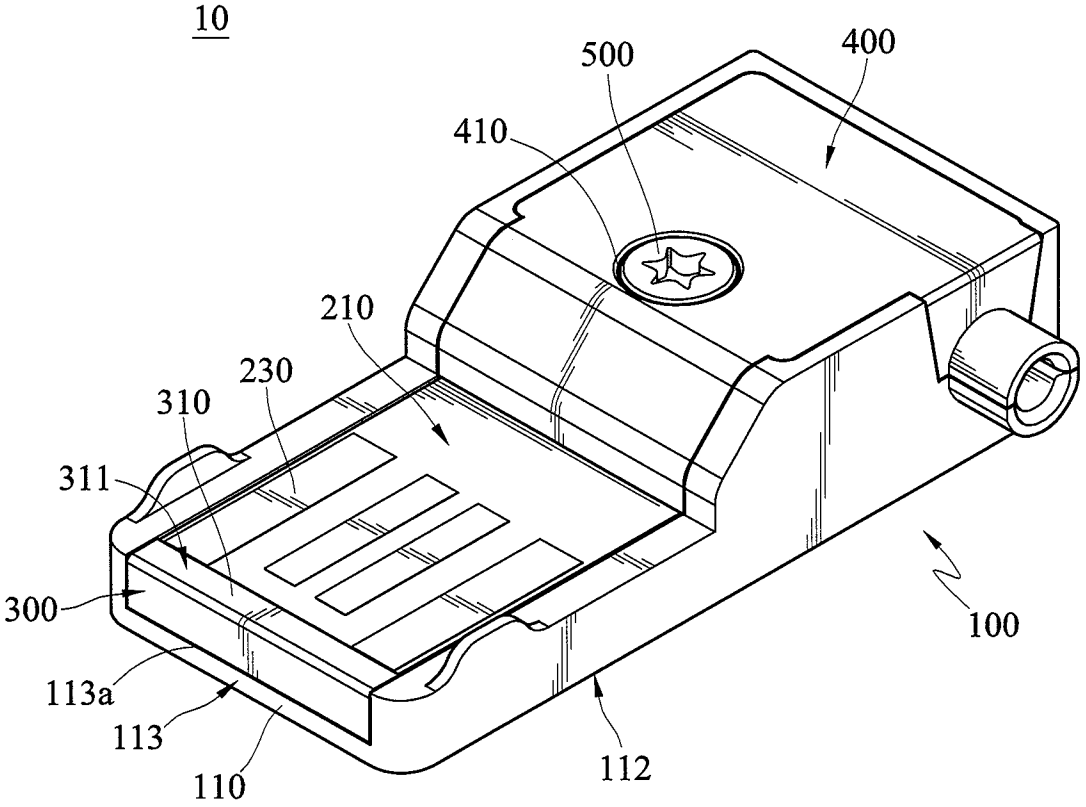
FIG. 1 is a perspective view of a signal transmitting connector according to a first embodiment of the disclosure.
Figure 2:
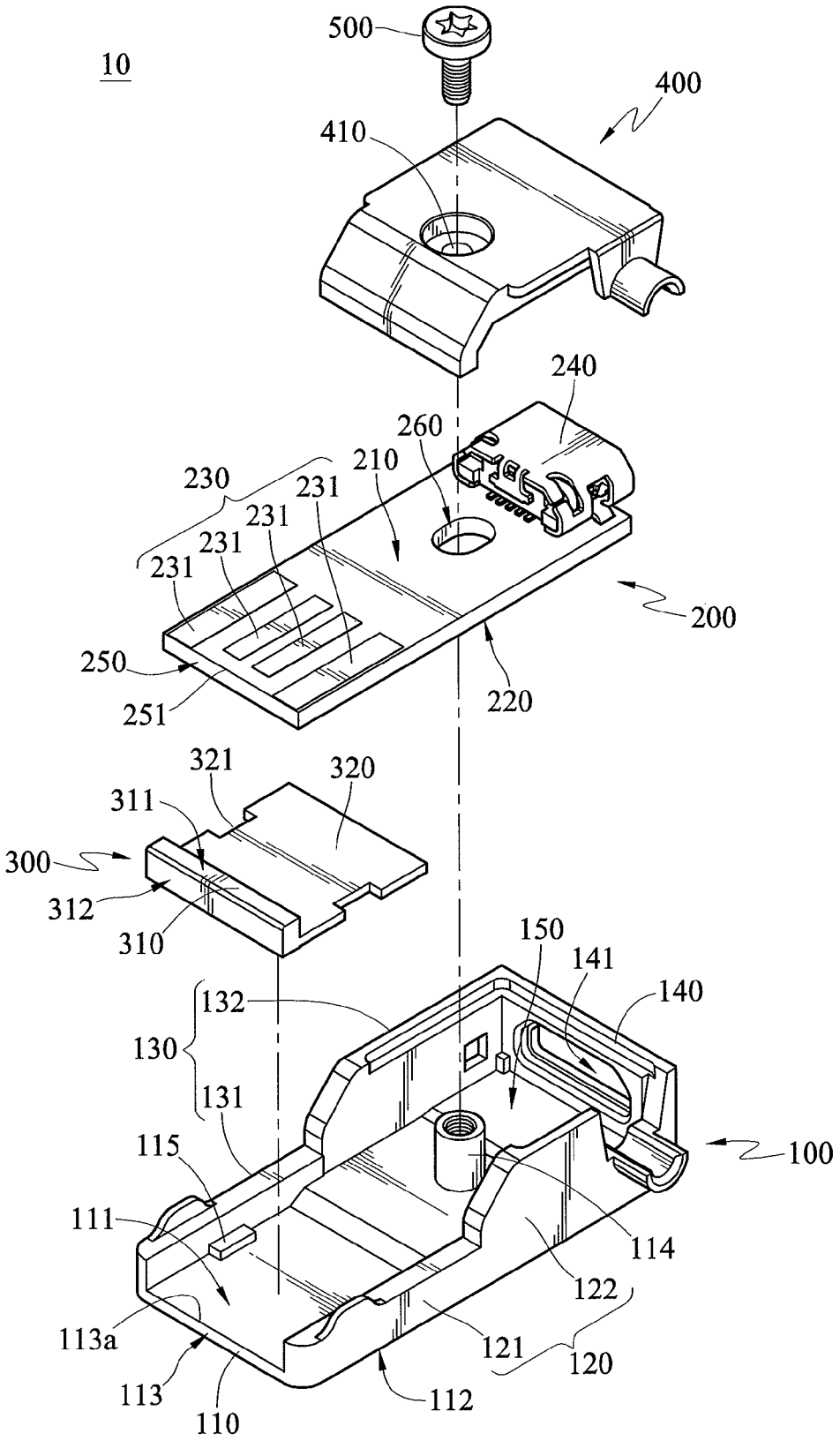
FIG. 2 is a schematic exploded view of FIG. 1.
Figure 3:
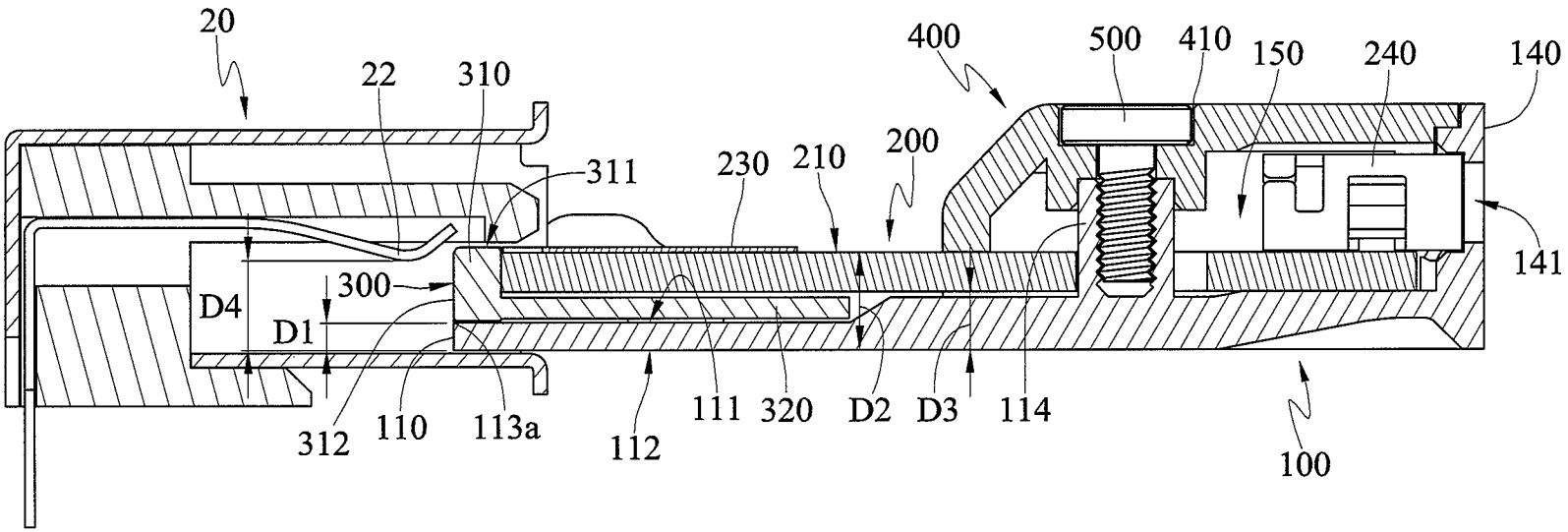
FIG. 3 is a schematic cross-sectional view of the signal transmitting connector that is not completely plugged into an electrically connecting port in FIG. 1.

Please refer to FIGS. 1 to 3. FIG. 1 is a perspective view of a signal transmitting connector according to a first embodiment of the disclosure. FIG. 2 is a schematic exploded view of FIG. 1. FIG. 3 is a schematic cross-sectional view of the signal transmitting connector that is not completely plugged into an electrically connecting port in FIG. 1.

A signal transmitting connector 10, in this embodiment, comprises a metal base 100, a circuit board 200, an electrically insulating body 300, a metal cover 400 and a fastening component 500. In this disclosure, the electrically insulating body 300, the metal cover 400 and the fastening component 500 may not be necessary components. However, the display of the above-mentioned components in FIG. 1 is for describing the relative positions between each component easily.

The metal base 100 includes a bottom plate 110, a first lateral plate 120, a second lateral plate 130, and a rear plate 140. The bottom plate 110 includes a first surface 111, a second surface 112 and an edge surface 113. The second surface 112 is opposite to the first surface 111. Two ends of the edge surface 113 are connected to the first surface 111 and the second surface 112, respectively. The edge surface 113 includes a first lateral side edge 113*a* farther away from the second surface 112, and all first lateral side edge 113*a* of the bottom plate 110 and the second surface 112 are separated by a first distance D1 (as shown in FIG. 3). In this embodiment, the bottom plate 110 includes a protruding tube 114 and a first positioning structure 115. The protruding tube 114 is connected to the first surface 111. The first positioning structure 115 is connected to the first surface 111.

The first lateral plate 120 and the second lateral plate 130 are connected to two opposite sides of the first surface 111. An extending surface of the edge surface 113 is intersected with both an extending surface of the first lateral plate 120 and that of the second lateral plate 130. The first lateral plate 120 includes a first wall section 121 and a second wall section 122 that are connected with each other, and the second lateral plate 130 includes a first wall section 131 and a second wall section 132 that are connected with each other. The lengths of the first wall sections 121 and 131 protruding from the first surface 111 is less than the lengths of the second wall sections 122 and 132 protruding from the first surface 111. Moreover, the above-mentioned protruding tube 114 is disposed between the two second wall sections 122 and 132.

The rear plate 140 is connected to the bottom plate 110 and between the second wall section 122 of the first lateral plate 120 and the second wall section 132 of the second lateral plate 130. The bottom plate 110, the first lateral plate 120, the second lateral plate 130 and the rear plate 140 form a depression 150 together. The first surface 111 is one of the surfaces which form the depression 150. In this embodiment, the rear plate 140 includes a hole 141, but is not limited thereto. In other embodiments, the first lateral plate 120 does not comprise the first wall sections 121 and 131, the second lateral plate 130 does not comprise the second wall section 122 and 132, and the rear plate 140 does not include the hole 141. In this embodiment, the bottom plate 110, the first lateral plate 120, the second lateral plate 130 and the rear plate 140 are metal structure which are integrally formed into one piece.

The circuit board 200, disposed in the depression 150, includes the third surface 210, a fourth surface 220 and a side surface 250. The fourth surface 220 and the side surface 250 are connected to two opposite sides of the third surface 210. The fourth surface 220 faces the bottom plate 110. In this embodiment, the third surface 210 and the second surface 112 are separated by a second distance D2 (as shown in FIG. 3). The fourth surface 220 and the second surface 112 are separated by a third distance D3 (as shown in FIG. 3), and the first distance D1 is less than or equal to the third distance D3. In this embodiment, the side surface 250 is connected between the third surface 210 and the fourth surface 220 as well as facing oppositely away from the rear plate 140. The side surface 250 includes a second side edge 251 intersected with the third surface 210.

A first electrically connecting portion 230 and a second electrically connecting portion 240 are disposed on the third surface 210 of the circuit board 200. The first electrically connecting portion 230 is closer to the side surface 250 than the second electrically connecting portion 240. In this embodiment, the first electrically connecting portion 230 is disposed between the two first wall sections 121 and 131, and the distance between the first electrically connecting portion 230 and the first surface 111 is substantially equaled to the lengths of the two first wall sections 121 and 131 protruding from the first surface 111. The second electrically connecting portion 240 is disposed between the second wall sections 122 and 132 and corresponds to the hole 141 of the rear plate 140. That is to say, the hole 141 exposes the second electrically connecting portion 240. In this embodiment, the first electrically connecting portion 230 includes a plurality of electrodes 231 which form a Universal Serial Bus (USB). The second electrically connecting portion 240 is a USB port, but is not limited thereto. In other embodiments, the circuit board 200 does not include the second electrically connecting portion 240, or the second electrically connecting portion 240 is a transmitting cable or other kinds of electrically connecting ports (e.g. memory card port). Moreover, in this or some other embodiments, an electrically insulating layer, e.g., an insulating attachment layer, covers surfaces of the other circuit board 200 except the surfaces of the first electrically connecting portion 230 and the second electrically connecting portion 240.

Furthermore, the circuit board 200 includes a first through hole 260 formed between the third surface 210 and the fourth surface 220. The protruding tube 114 of the bottom plate 110 passes through the first through hole 260 of the circuit board 200 for limiting the movement of the circuit board 200 in the horizontal direction. However, the horizontal movement of the circuit board 200 limited by the protruding tube 114 and the first through hole 260 is only for example, and is not limited thereto. In other embodiments, the signal transmitting connector 10 does not comprise the protruding tube 114 or the first through hole 260, and other limiting combination (e.g., a limiting block and a limiting recess) is disposed to apply the limiting effect.

The electrically insulating body 300 includes a blocking portion 310 and a connecting portion 320. The blocking portion 310 is connected to the connecting portion 320. The blocking portion 310 is disposed between the first lateral plate 120 and the second lateral plate 130, and faces the side surface 250 of the circuit board 200. The blocking portion 310 includes a top surface 311 opposite to the second surface 112.

In this embodiment, the blocking portion 310 totally covers the side surface 250 of the circuit board 200. That is to say, at least part of the blocking portion 310 is in contact with the second side edge 251. Furthermore, the top surface 311 is coplanar with the third surface 210, but is not limited thereto. In other embodiments, the top surface 311 is not coplanar with the third surface 210, and a part of side surface 250 of the circuit board 200 is exposed. At least part of the connecting portion 320 is disposed between the first surface 111 and the fourth surface 220. The connecting portion 320 includes at least one second positioning structure 321. The second positioning structure 321 is detachably engaged with the first positioning structure 115 for setting the relative position of the electrically insulating body 300 and the bottom plate 110.

In this embodiment, the electrically insulating body 300 includes the blocking portion 310 and the connecting portion 320, but is not limited to the disclosure. In other embodiments, the electrically insulating body 300 only includes the blocking portion 310 which is disposed between the first lateral plate 120 and the second lateral plate 130 by tightly fitting or buckling The metal cover 400 includes a second through hole 410. The fastening component 500 passes through the second through hole 410 and is affixed to the protruding tube 114 of the bottom plate 110. The metal cover 400 covers the second electrically connecting portion 240 and a part of the depression 150 as well as exposing the first electrically connecting portion 230.

However, the above-mentioned electrically insulating body 300, the protruding tube 114, each sidewall and the rear plate 140 are selective components, and are not limited to the disclosure. In other embodiments, the signal transmitting connector 10 does not comprise the electrically insulating body 300, the protruding tube 114, each sidewall and the rear plate 140.

Figure 4:
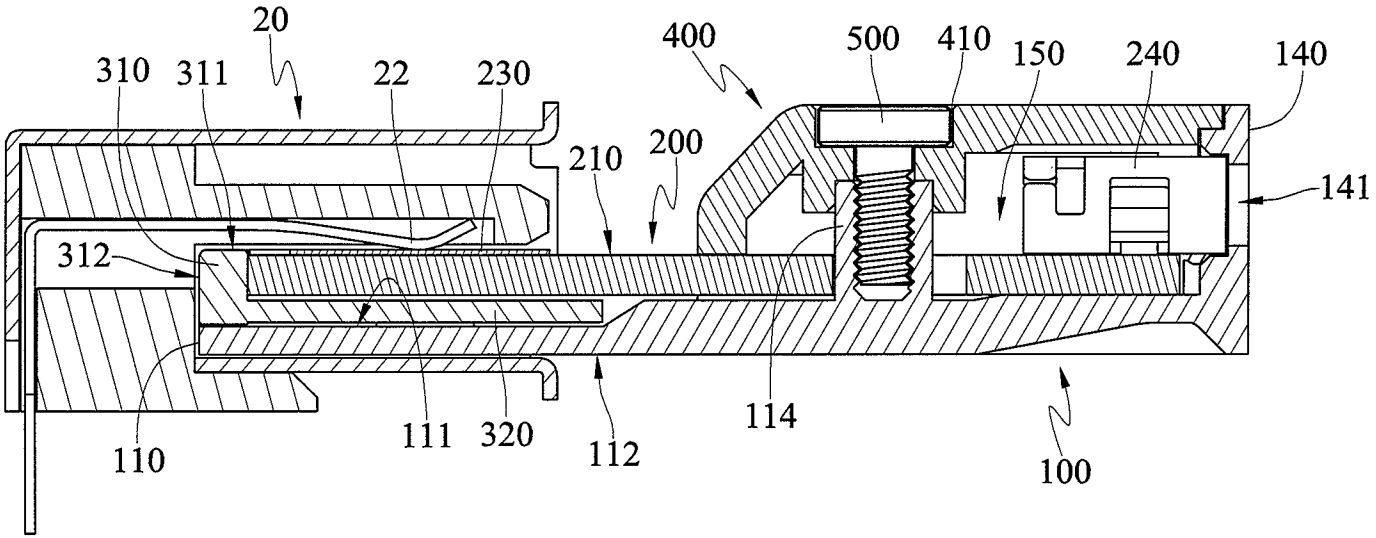
FIG. 4 is a schematic cross-sectional view of the signal transmitting connector that is completely plugged into the electrically connecting port in FIG. 1.

Please refer to FIGS. 3 and 4, and FIG. 4 is a schematic cross-sectional view of the signal transmitting connector that is completely plugged into the electrically connecting port in FIG. 1.

As shown in FIG. 3, the signal transmitting connector 10 in this embodiment is not completely plugged into an electrically connecting port 20. The electrically connecting port 20 includes a plurality of metal flexible sheet 22 electrically connected to the first electrically connecting portion 230. Based on the manufacturer standard, a fourth distance D4 between the metal flexible sheet 22 and the second surface 112 (as shown in FIG. 3) is between the second distance D2 and the third distance D3. According to this embodiment, the first distance D1 between the first lateral side edge 113*a* and the second surface 112 is less than or equal to the third distance D3 between the fourth surface 220 and the second surface 112. It is ensured that when the signal transmitting connector 10 is plugged into the electrically connecting port 20, the metal flexible sheet 22 of the electrically connecting port 20 is only in contact with the blocking portion 310 which is at the side edge 113*a* without being in contact with the metal base 100. Therefore, the short circuit, generated by the metal flexible sheet 22 from being in electrical contact with the metal base 100, is avoided.

However, in this embodiment, in order to be compliant with each manufacturer standard of the electrically connecting port, the first distance D1 between the first lateral side edge 113*a* and the second surface 112 is designed to be less than the third distance D3 between the fourth surface 220 and the second surface 112, but is not limited thereto. If the manufacturer is aware of the fourth distance D4 between the metal flexible sheet 22 and the second surface 112, the first distance D1 between the first lateral side edge 113*a* and the second surface 112 is designed between the second distance D2 and the third distance D3. Only the fourth distance D4 is greater than the first distance D1, the metal flexible sheet 22 is not in contact with the metal base 110, which avoids the short circuit of the electrically connecting port 20.

Figure 5:
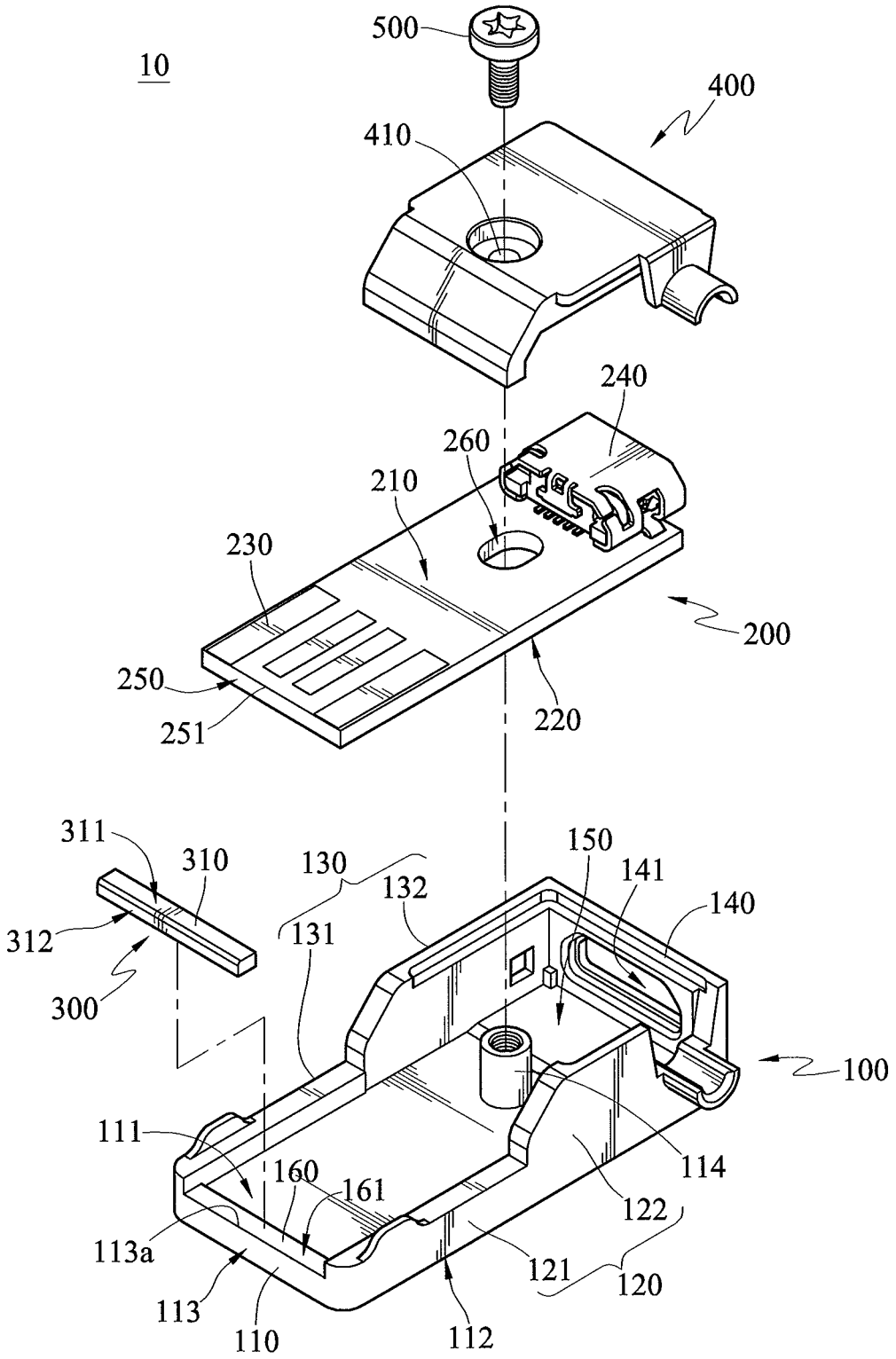
FIG. 5 is a schematic exploded view of a signal transmitting connector according to a second embodiment of the disclosure.
Figure 6:
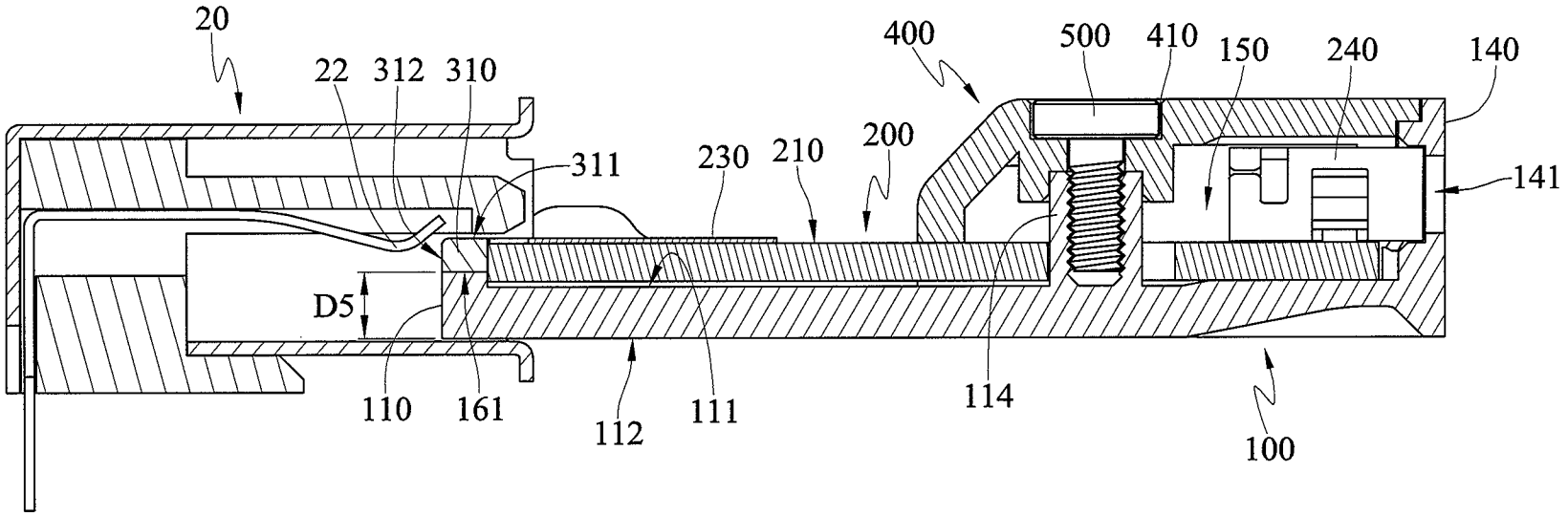
FIG. 6 is a schematic cross-sectional view of the signal transmitting connector that is assembled in FIG. 5.

Please refer to FIGS. 5 and 6. FIG. 5 is a schematic exploded view of a signal transmitting connector according to a second embodiment of the disclosure. FIG. 6 is a schematic cross-sectional view of the signal transmitting connector that is assembled in FIG. 5. The configuration of the signal transmitting connector 10 in this embodiment is similar to that of the signal transmitting connector 10 in FIG. 1, and therefore only the differences are described hereinafter.

A metal base 100, in this embodiment, includes a bottom plate 110, a first lateral plate 120, a second lateral plate 130, a rear plate 140 and an opening portion 160.

The bottom plate 110 includes a first surface 111, a second surface 112 and an edge surface 113. The second surface 112 is opposite to the first surface 111. The edge surface 113 is connected between the first surface 111 and the second surface 112. The edge surface 113 includes a first lateral side edge 113*a* facing oppositely away from the second surface 112. The first lateral side edge 113*a* of the bottom plate 110 and the second surface 112 are separated by a first distance D1 (as shown in FIG. 6).

The first lateral plate 120 and the second lateral plate 130 are connected to two opposite sides of the first surface 111, respectively.

The rear plate 140 is connected to the bottom plate 110 as well as between the second wall section 122 of the first lateral plate 120 and the second wall section 132 of the second lateral plate 130. The bottom plate 110, the first lateral plate 120, the second lateral plate 130 and the rear plate 140 form a depression 150 together. The first surface 111 is one of the surfaces which form the depression 150.

The opening portion 160 and the rear plate 140 are defined to be two opposite surfaces of the depression 150. That is to say, the edge surface 113 is located at the opening portion 160. The opening portion 160 exposes at least part of the side surface 250. In this embodiment, the opening portion 160 includes a bottom surface 161 which is opposite to the second surface 112. The bottom surface 161 and the second surface 112 are separated by a fifth distance D5.

The circuit board 200 is disposed in the depression 150. The circuit board 200 includes a third surface 210, a fourth surface 220 and a side surface 250. The fourth surface 220 and the third surface 210 are two opposite surfaces of the circuit board 200. The fourth surface 220 faces the bottom plate 110. In this embodiment, the third surface 210 and the second surface 112 are separated by a second distance D2 (as shown in FIG. 6). The fourth surface 220 and the second surface 112 are separated by a third distance D3 (as shown in FIG. 6). In this embodiment, the fifth distance D5 is less than the second distance D2 and greater than the third distance D3.

In this and some other embodiments, the signal transmitting connector 10 further comprises an electrically insulating body 300. The electrically insulating body 300 is disposed on the opening portion 160, and at least part of the electrically insulating body 300 is disposed between the first surface 111 and the third surface 210. Moreover, in this embodiment, the electrically insulating body 300 includes a top surface 311 and a front surface 312. The top surface 311 of the electrically insulating body 300 is coplanar with the third surface 210, and the front surface 312 is coplanar and aligns with the edge surface 113 of the opening portion 160. However, the electrically insulating body 300 may be disposed on the opening portion 160 by the combination of an engaging block and an engaging recess, adhesion or tightly fitting, but the disposition manner is not limited to the disclosure.

Figure 7:
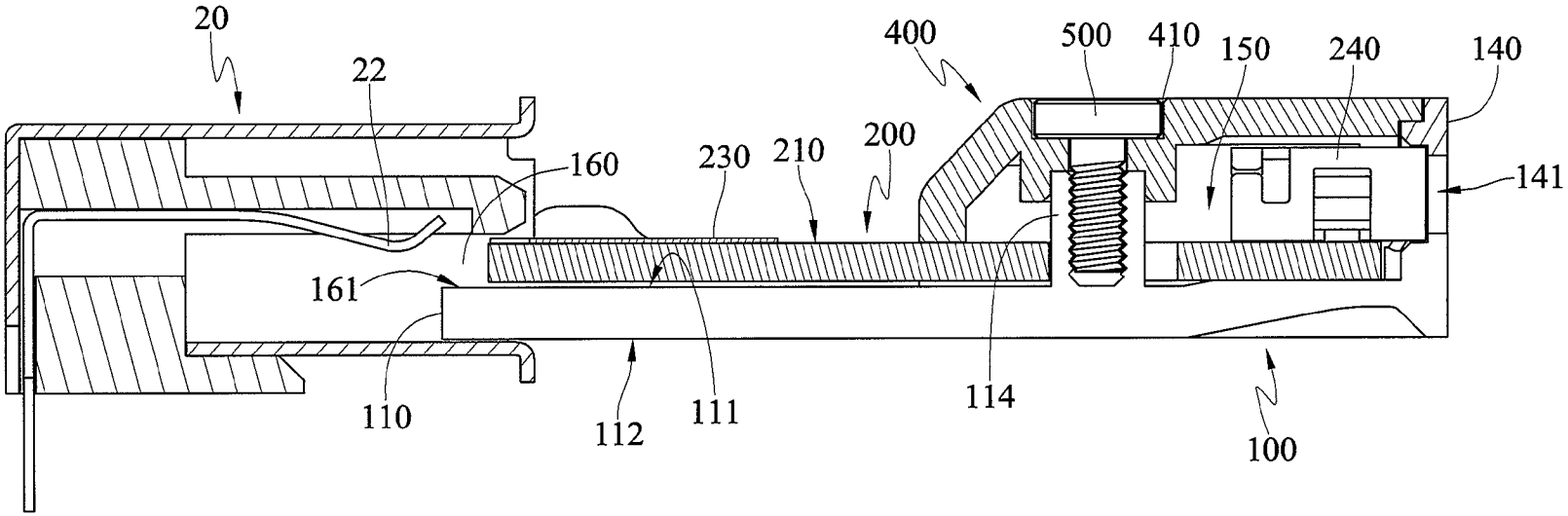
FIG. 7 is a schematic cross-sectional view of a signal transmitting connector according to a third embodiment of the disclosure.

Please refer to FIG. 7, which is a schematic cross-sectional view of a signal transmitting connector according to a third embodiment of the disclosure. The configuration of the signal transmitting connector 10 in this embodiment is similar to that of the signal transmitting connector 10 in FIG. 5, and therefore only the differences are described hereinafter. In this embodiment, the bottom surface 161 of the opening portion 160 is coplanar with the first surface 111.

Figure 8:
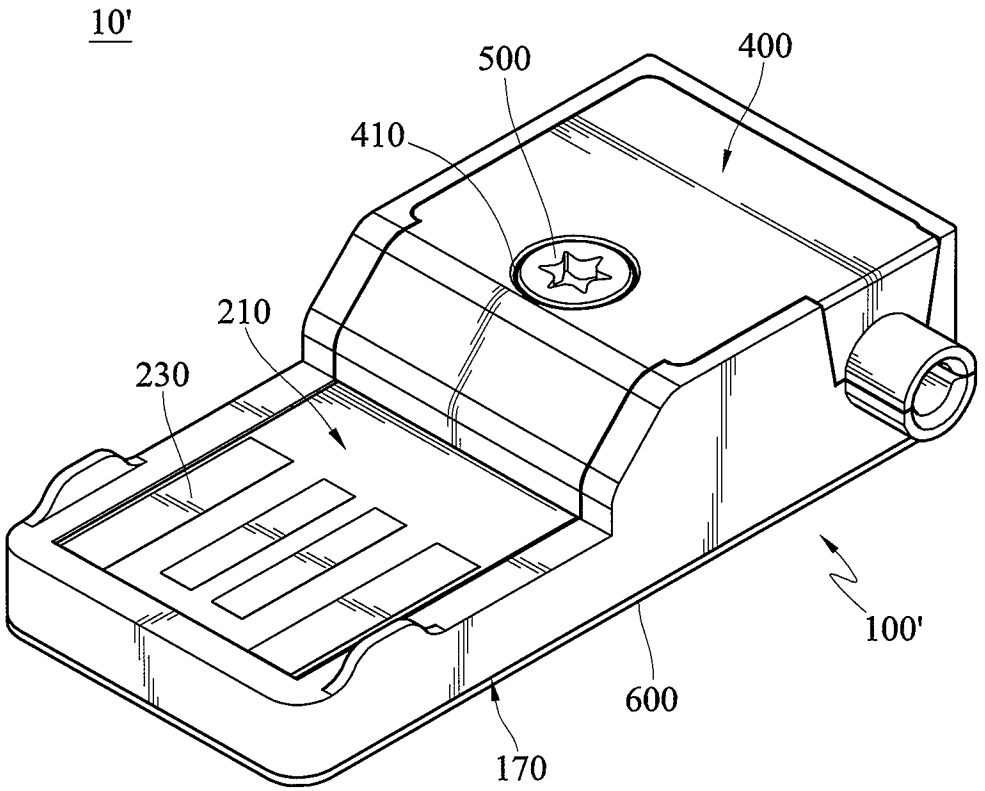
FIG. 8 is a schematic cross-sectional view of a signal transmitting connector according to a fourth embodiment of the disclosure.

Please refer to FIG. 8, which is a schematic cross-sectional view of a signal transmitting connector according to a fourth embodiment of the disclosure. The configuration of the signal transmitting connector 10' in this embodiment is similar to that of the signal transmitting connector 10 in FIG. 1. The differences between them are that the structure of the metal base 100 and the electrically insulating body 300 of FIG. 1 are integrated into one piece to form an electrically insulating base 100' in this embodiment (as shown in FIG. 8), and the material of the electrically insulating base 100' is an electrically insulating material (e.g., plastic). The electrically insulating base 100' includes a fifth surface 170 which faces oppositely away from the third surface 210. The signal transmitting connector 10 in this embodiment further comprises a metal plate 600 attached to the fifth surface 170. However, the disclosure does not limit that the metal plate 600 is only attached to the fifth surface 170 of the metal base 100. In other embodiments, the metal plate also covers other adjacent lateral plates (e.g., the above-mentioned first lateral plate or the second lateral plate).

Figure 9:
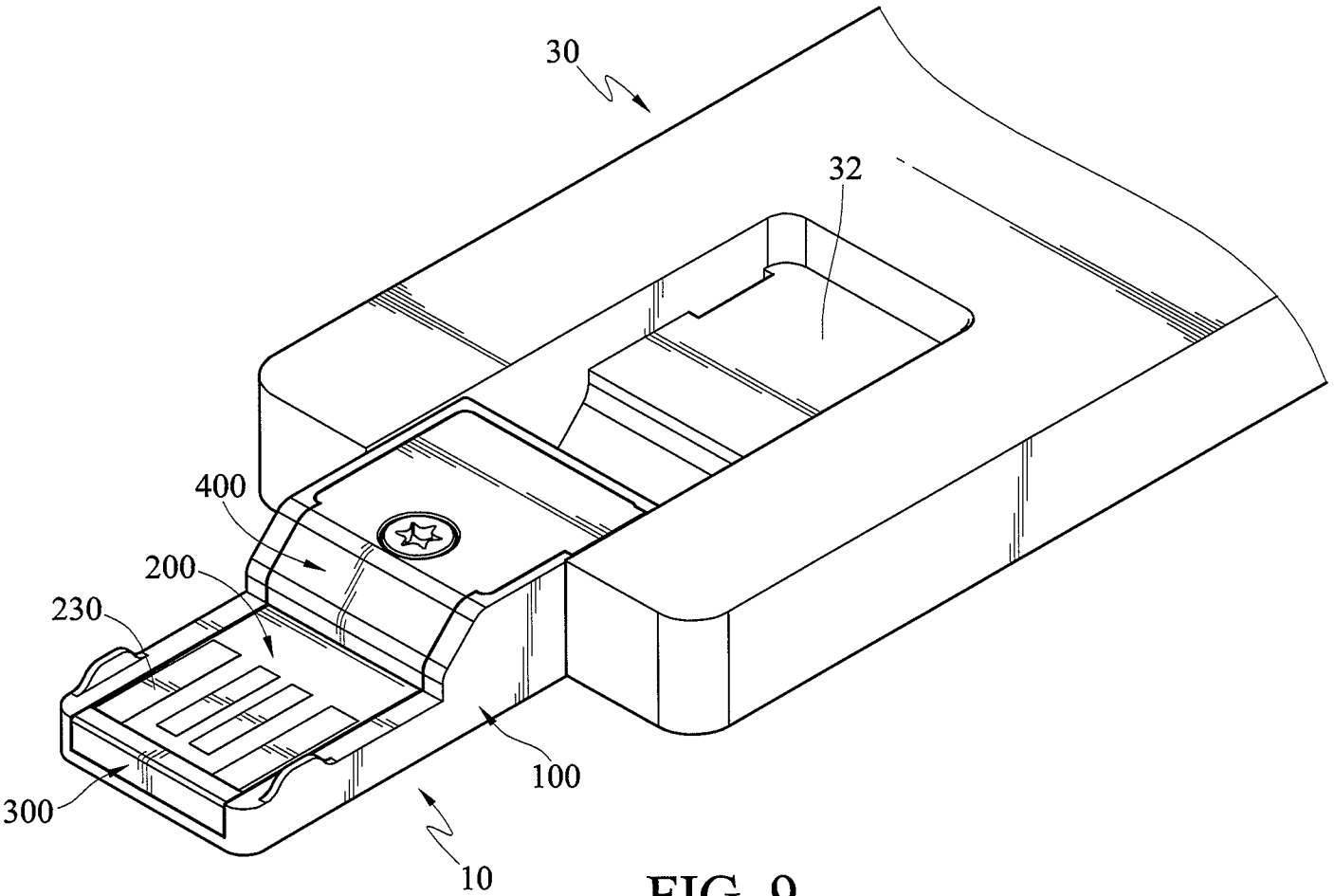
FIG. 9 is a perspective view of the signal transmitting connector that is pivoted to an electronic device in FIG. 1.
Figure 10:
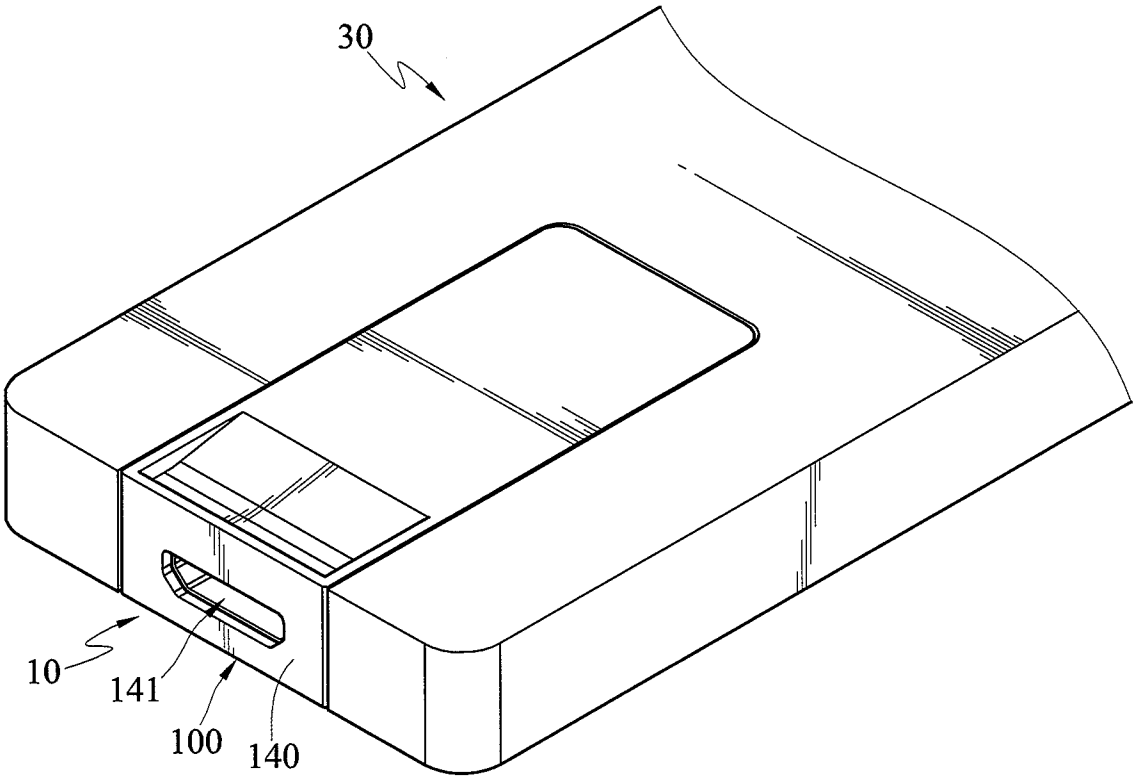
FIG. 10 is a perspective view of the signal transmitting connector that is pivoted to the electronic device in FIG. 1.

Please refer to FIGS. 9 and 10. FIG. 9 is a perspective view of the signal transmitting connector that is pivoted to an electronic device in FIG. 1. FIG. 10 is a perspective view of the signal transmitting connector that is pivoted to the electronic device in FIG. 1. The above-mentioned electronic device 30 is a portable hard disk drive or portable energy device (e.g., portable energy station), but is not limited to thereto. The electronic device 30 includes a recess 32 on which the signal transmitting connector 10 is pivoted. As shown in FIG. 9, the signal transmitting connector 10 is capable of pivoting with respect to the electronic device 30 so as to expose the first electrically connecting portion 230. As shown in FIG. 10, the signal transmitting connector 10 is capable of pivoting with respect to the electronic device 30 so as to be stored in the recess 32 and to expose the second electrically connecting portion 240.

Figure 11:
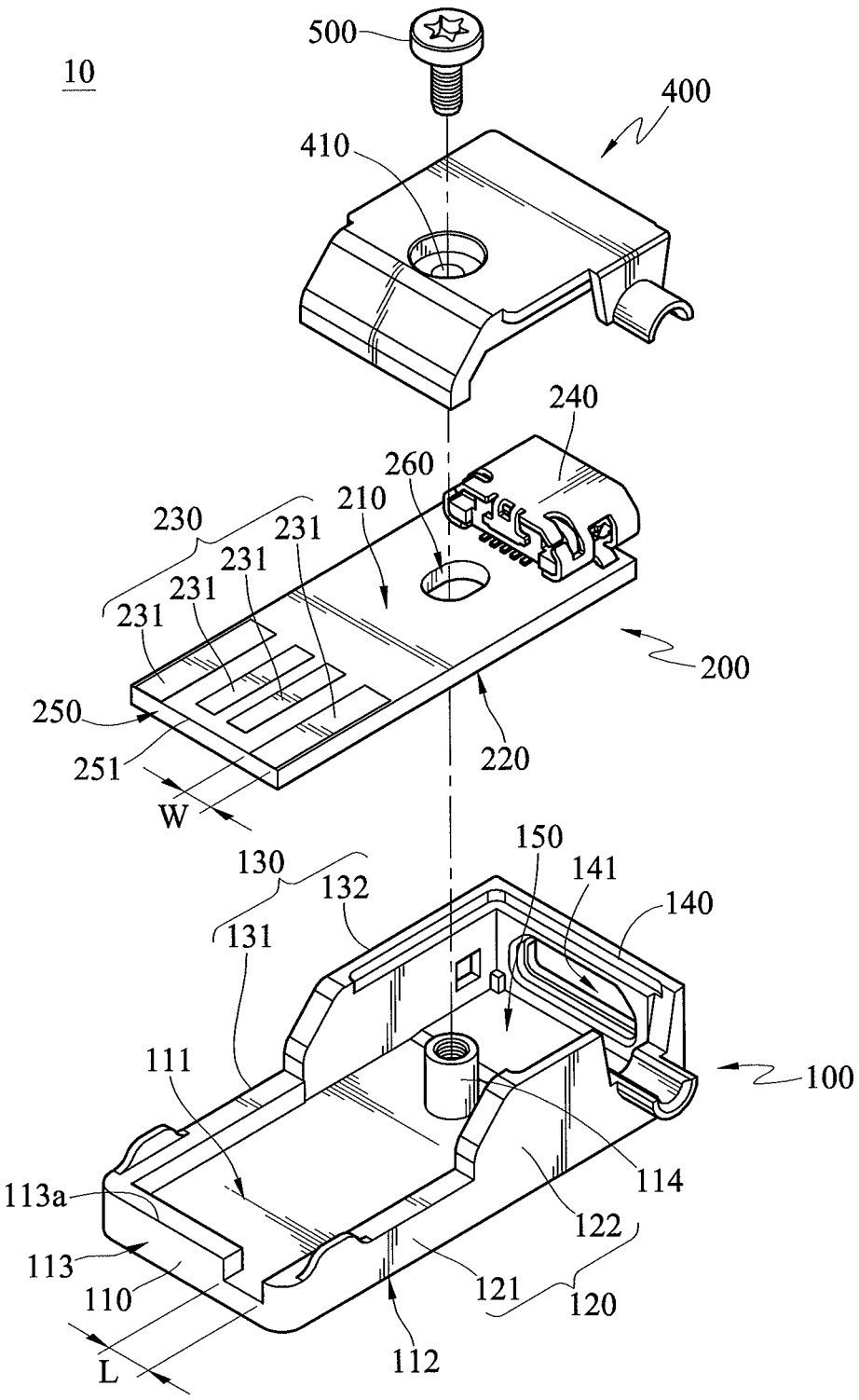
FIG. 11 is a schematic exploded view of a signal transmitting connector according to a fifth embodiment of the disclosure.
Figure 12:
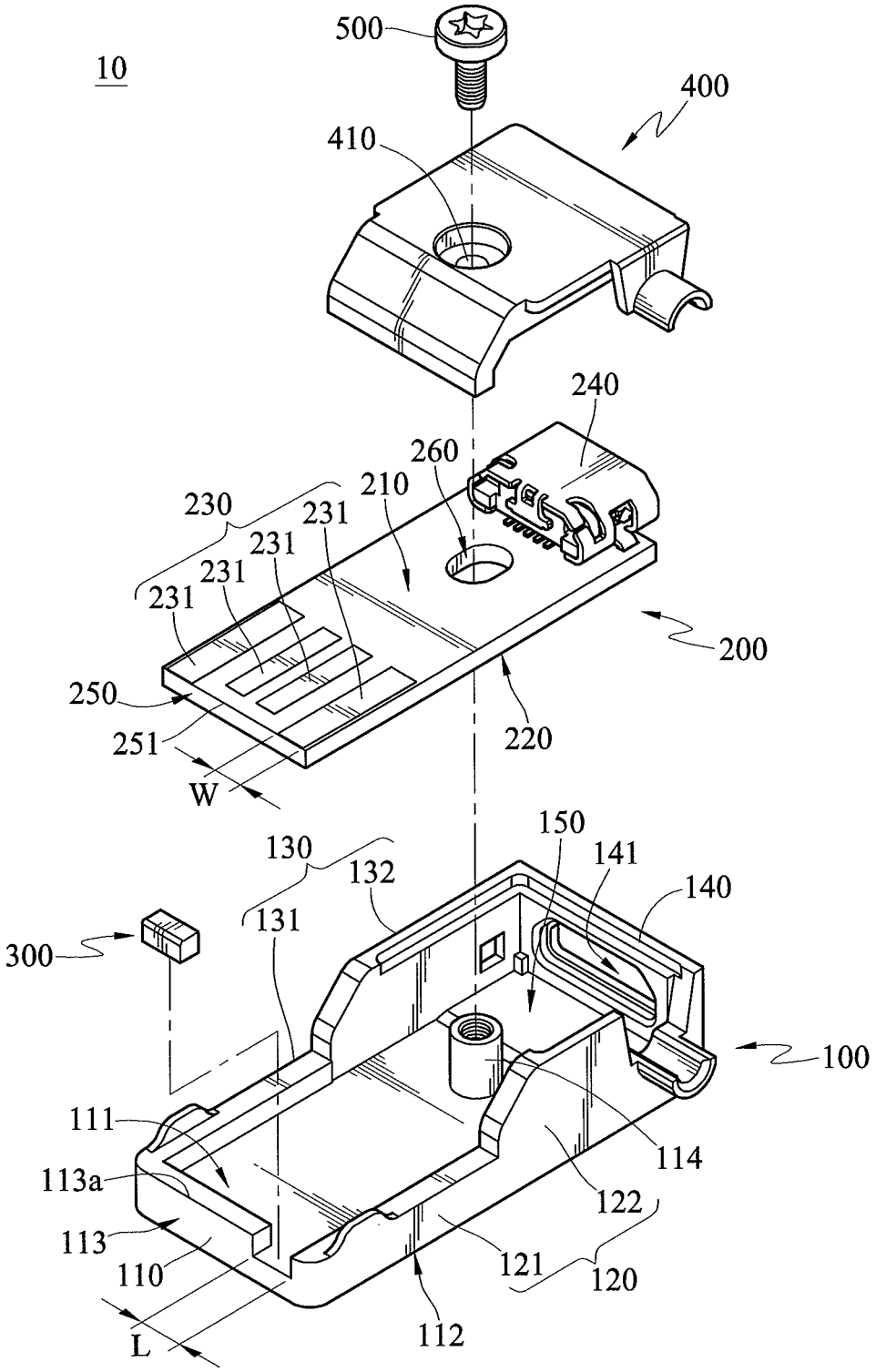
FIG. 12 is a schematic exploded view of a signal transmitting connector according to a sixth embodiment of the disclosure.

In the above-mentioned embodiments, all parts of the first lateral side edge 113*a* are less than the second distance D2 or less than or equal to the third distance D3, but are not limited to the disclosure. In other embodiments, a part of the first lateral side edge 113*a* are less than the second distance D2 or less than or equaled to the third distance D3. Please refer to FIGS. 11 and 12. FIG. 11 is a schematic exploded view of a signal transmitting connector according to a fifth embodiment of the disclosure. FIG. 12 is a schematic exploded view of a signal transmitting connector according to a sixth embodiment of the disclosure. The configurations in FIG. 11 and those in FIG. 12 are similar to those in FIG. 1, and therefore only the differences are described hereinafter.

As shown in FIG. 11, a part of the first lateral side edge 113*a* and the second surface 112 are separated by a first distance (i.e., D1 in FIG. 3) which is less than or equal to the third distance (i.e., D3 in FIG. 3). In other words, the first lateral side edge 113*a* is a polyline having a plurality of line segments, the horizontal height of a part of the first lateral side edge 113*a* is lower than that of the third surface 210, and the horizontal height of another part of the first lateral side edge 113*a* is equal to that of the third surface 210. In this embodiment, the minimum value of length L of the first lateral side edge 113*a*, whose horizontal height is lower than the third surface 210, is equal to the width W of one of the electrodes 231. The electrode 231 is a positive electrode (Vcc). In this way, the short circuit, generated by the electrical connection between the positive electrode (as shown in FIG. 3) and the flexible sheet 22 of the electrically connecting port 20, is avoided.

As shown in FIG. 12, the signal transmitting connector 10 in this embodiment further comprises an electrically insulating body 300 disposed on the metal base 100. The horizontal height of the electrically insulating body 300 at the first lateral side edge 113*a* is equal to that of the third surface 210, for covering the exposed circuit board 200 (i.e., the side surface 250 of the circuit board 200). Furthermore, the electrically insulating body 300 is disposed on the metal base 100 by the combination of the engaging block and the engaging recess, adhesion or tightly fitting, but the disposition manner is not limited to the disclosure.

According to the signal transmitting connector of this disclosure, the distance between the metal flexible sheet and the second surface is greater than the distance between the fourth surface and the second surface, and the distance between the first lateral side edge and the second surface is less than or equal to the distance between the fourth surface and the second surface. It is ensured that when the signal transmitting connector is plugged into the electrically connecting port, the metal flexible sheet of the electrically connecting port is only in contact with the blocking portion of the side edge of the electrically insulating body without being in contact with the metal base. Therefore, the short circuit of the electrically connecting port, generated by the metal flexible sheet from being in electrical contact with the metal base, is avoided.

Moreover, when the distance between the flexible sheet and the second surface is known, the first distance between the first lateral side edge and the second surface is designed to be between the second distance and the third distance. Only the fourth distance is greater than the first distance, the metal flexible sheet is not in contact with the metal base, which prevents the short circuit of the electrically connecting port.

Furthermore, in this disclosure, because the housing of the signal transmitting connector is almost made out of metal, the quality of the signal transmitting connector is better so as to enhance the willingness of buying from consumers.

According to the above-mentioned signal transmitting connector in this disclosure, the electrically insulating body is further disposed to cover the side surface of the circuit board, which prevents the side surface of the circuit board from being exposed, thereby enhancing the appearance of the signal transmitting connector.

What is claimed is:

1. A signal transmitting connector, comprising:

a metal base including a bottom plate, a first lateral plate and a second lateral plate, the bottom plate including a first surface, a second surface and an edge surface, wherein the second surface and the first surface are opposite to each other, the edge surface is connected between the first surface and the second surface, the first lateral plate and the second lateral plate are connected to two opposite sides of the first surface, respectively, wherein an extending plane of the edge surface is intersected by the first lateral plate and the second lateral plate, and wherein the bottom plate, the first lateral plate and the second lateral plate form a depression together; and a circuit board disposed in the depression, the circuit board including a third surface and a fourth surface opposite to each other, the fourth surface facing the bottom plate, a first electrically connecting portion disposed on the third surface, wherein at least a part of a first lateral side edge of the edge surface farther away from the second surface and the second surface are separated by a first distance, wherein the third surface and the second surface are separated by a second distance, and the first distance is less than the second distance.

2. The signal transmitting connector according to claim 1, wherein the fourth surface and the second surface are separated by a third distance, and the first distance is less than or equal to the third distance.

3. The signal transmitting connector according to claim 1, further comprising an electrically insulating body, the electrically insulating body further comprising a blocking portion, wherein the blocking portion is disposed between the first lateral plate and the second lateral plate, the blocking portion faces a side surface of the circuit board, and the side surface is connected between the third surface and the fourth surface.

4. The signal transmitting connector according to claim 3, wherein an extending plane of the side surface is intersected by the first lateral plate and the second lateral plate.

5. The signal transmitting connector according to claim 3, wherein the electrically insulating body further includes a connecting portion, and at least part of the connecting portion is disposed between the first surface and the fourth surface.

6. The signal transmitting connector according to claim 5, wherein the bottom plate includes at least one first positioning structure, the connecting portion includes at least one second positioning structure, and the first positioning structure is detachably engaged with the second positioning structure.

7. The signal transmitting connector according to claim 3, wherein the circuit board includes a second side edge intersected by the third surface and the side surface, and the blocking portion is in contact with the second side edge.

8. The signal transmitting connector according to claim 7, wherein the blocking portion includes a top surface opposite to the second surface, and the top surface and the third surface are coplanar with each other.

9. The signal transmitting connector according to claim 1, wherein the bottom plate includes a protruding tube, the protruding tube passes through a first through hole of the circuit board, and the circuit board is securely disposed on the bottom plate.

10. The signal transmitting connector according to claim 1, further comprising a metal cover disposed on the metal base, and wherein a part of the circuit board is covered by the metal cover that exposes the first electrically connecting portion.

11. The signal transmitting connector according to claim 10, wherein the protruding tube aligns with a second through hole of the metal cover, a fastening component of the signal transmitting connector passes through the second through hole and is securely disposed in the protruding tube, and the metal base is affixed to the metal cover.

12. The signal transmitting connector according to claim 1, wherein the metal base further includes a rear plate connected between the first lateral plate and the second lateral plate, wherein the bottom plate, the first lateral plate, the second lateral plate and the rear plate forms the depression, the circuit board includes a second side edge intersected by the third surface and the side surface, the metal base includes an opening portion disposed on the second side edge, the opening portion and the rear plate are two opposite planes of the depression, and at least a part of the side surface is exposed by the opening portion.

13. The signal transmitting connector according to claim 12, further comprising an electrically insulating body disposed on the opening portion, and wherein at least a part of the electrically insulating body is disposed between the first surface and the third surface.

14. The signal transmitting connector according to claim 12, wherein a part of the electrically insulating body is disposed between the first surface and the third surface, a part of the electrically insulating body extends towards and is coplanar with the opening portion of the depression.

15. The signal transmitting connector according to claim 14, wherein the electrically insulating body includes a top surface opposite to the second surface, and the top surface is coplanar with the third surface.

16. The signal transmitting connector according to claim 1, wherein the first electrically connecting portion includes a plurality of electrodes which forms a Universal Serial Bus (USB).

17. The signal transmitting connector according to claim 16, wherein the length of a part of the first lateral side edge, where the first distance is less than the second distance, and is greater than or equaled to the width of one of the electrodes.

18. The signal transmitting connector according to claim 1, wherein all of the edge surface farther away from the first lateral side edge of the second surface and the second surface are separated by the first distance, and the first distance is less than the second distance.

* * * * *